US005964228A

United States Patent [19]

Chang

[11] Patent Number: 5,964,228

[45] Date of Patent: Oct. 12, 1999

[54] HAIR HOLDER

[76] Inventor: Wen Hsiung Chang, No. 7, Alley 116, Lane 175, Sec. 1, Ta Tung Rd., Tainan City, Taiwan

[21] Appl. No.: 09/311,872

[22] Filed: May 14, 1999

[51] Int. Cl.[6] ..... A45D 8/20

[52] U.S. Cl. ..... 132/277; 132/133; 132/138

[58] Field of Search ..... 132/277, 276, 132/278, 279, 219, 282, 126, 129, 133, 137, 138; D28/39, 40, 41, 42, 43

[56] References Cited

U.S. PATENT DOCUMENTS

| | | | |
|---|---|---|---|
| 686,148 | 11/1901 | Seibel | 132/133 |
| 955,271 | 4/1910 | Keroff | 132/133 |
| 4,414,992 | 11/1983 | Russell | 132/138 |
| 5,549,127 | 8/1996 | Chang | 132/277 |
| 5,735,296 | 4/1998 | Chen | 132/277 |
| 5,862,815 | 1/1999 | Murphy et al. | 132/277 |

*Primary Examiner*—Gene Mancene
*Assistant Examiner*—Philogene Pedro
*Attorney, Agent, or Firm*—Charles E. Baxley, Esq.

[57] ABSTRACT

A hair holder includes two symmetric holder members made of flexible material. Each holder member includes a first portion for holding hair, a second portion for retaining hair, and a transition portion interconnecting the first portion and the second portion in an acute angle to thereby define a hair holding space therebetween. The first portion of each holder member includes a number of first slits spaced along a width thereof to thereby define a number of first teeth spaced along the width. The second portion of each holder member includes a number of second slits spaced along a width thereof to thereby define a number of second teeth spaced along the width. The width of each second tooth increases from a distal end of the second portion to the transition portion, thereby defining an engaging portion adjacent to the transition portion. When in use, the second teeth of one of the holder members are inserted through the second slits of the other holder member until the engaging portions of the second portions of the holder members engage with each other. The first teeth of one of the holder members are inserted through the first slits of the other holder member.

2 Claims, 5 Drawing Sheets

HAIR HOLDER

BACKGROUND OF THE INVENTION

1. Field of the Invention

The present invention relates to a hair holder that can quickly hold the hair in place so as not to interfere with motions of the head. The hair holder can be manufactured and operated quickly and easily.

2. Description of the Related Art

Women with long hair usually use all kinds of hair holders to provide aesthetically pleasing effect and to prevent the hair from fluttering or getting wet during working, cycling, bathing, etc. The neck area of the user of the hair holder may be relieved from heat since the hair holder provides an additional function of ventilation. There are a wide variety of hair holders, and FIG. 5 illustrates a typical one of them. As can be seen from FIG. 5, a typical hair holder includes two holder plates 1' and 2', a metal spring 3', and a pin 4'. Several spaced teeth 11', 12' are defined in a bottom end of each holder plate 1', 2', and the other end of each holder plate 1', 2' includes a press portion 12', 22'. A pivotal section 13', 23' is formed in an inner side of each holder plate 1', 2', and the pin 4' is extended through aligned pinholes 14', 24' of the pivotal sections 13' 23'. Two ends of the spring 3' around the pin 4' are attached to upper portions of the inner sides of the holder plates 1' and 2', respectively. The teeth 11' and 21' together hold the user's hair under the action of the spring 3'.

Nevertheless, when in use, as shown in FIG. 6, the press portions 12' and 22' of the holder plates 1' and 2' are exposed outside the hair and thus tend to be displaced or even disengaged from the hair as a result of being impinged by an object. The metal spring 3' and the pin 4' are exposed and thus adversely affect the aesthetically pleasing effect. In addition, manufacture and assembly of the spring 3' and the pin 4' are time-consuming and costly.

The present invention is intended to provide a hair holder that mitigates and/or obviates the above problems.

SUMMARY OF THE INVENTION

A hair holder in accordance with the present invention comprises two symmetric holder members made of flexible material. Each holder member includes a first portion for holding hair, a second portion for retaining hair, and a transition portion interconnecting the first portion and the second portion in an acute angle to thereby define a hair holding space therebetween.

The first portion of each holder member includes a plurality of first slits spaced along a width thereof to thereby define a plurality of first teeth spaced along the width. The second portion of each holder member includes a plurality of second slits spaced along a width thereof to thereby define a plurality of second teeth spaced along the width. The width of each second tooth increases from a distal end of the second portion to the transition portion, thereby defining an engaging portion adjacent to the transition portion.

When in use, the second teeth of one of the holder members are inserted through the second slits of the other holder member until the engaging portions of the second portions of the holder members engage with each other. The first teeth of one of the holder members are inserted through the first slits of the other holder member.

The first portion of each holder member further includes a distal end that forms a grasp portion to allow disengagement of the holder members when the grasp portion of each holder member is grasped.

Most portions of the holder members are hidden and thus less likely to be displaced or even disengaged from the hair as a result of being impinged by an alien object. This allows the user to move her head more freely. In addition, the holder members can be manufactured at high efficiency. Time-consuming and costly assembly procedure of the conventional hair holder with a pin and a spring is not required. Configuration of the holder members allows easy use and easy removal, and the holding effect is reliable.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
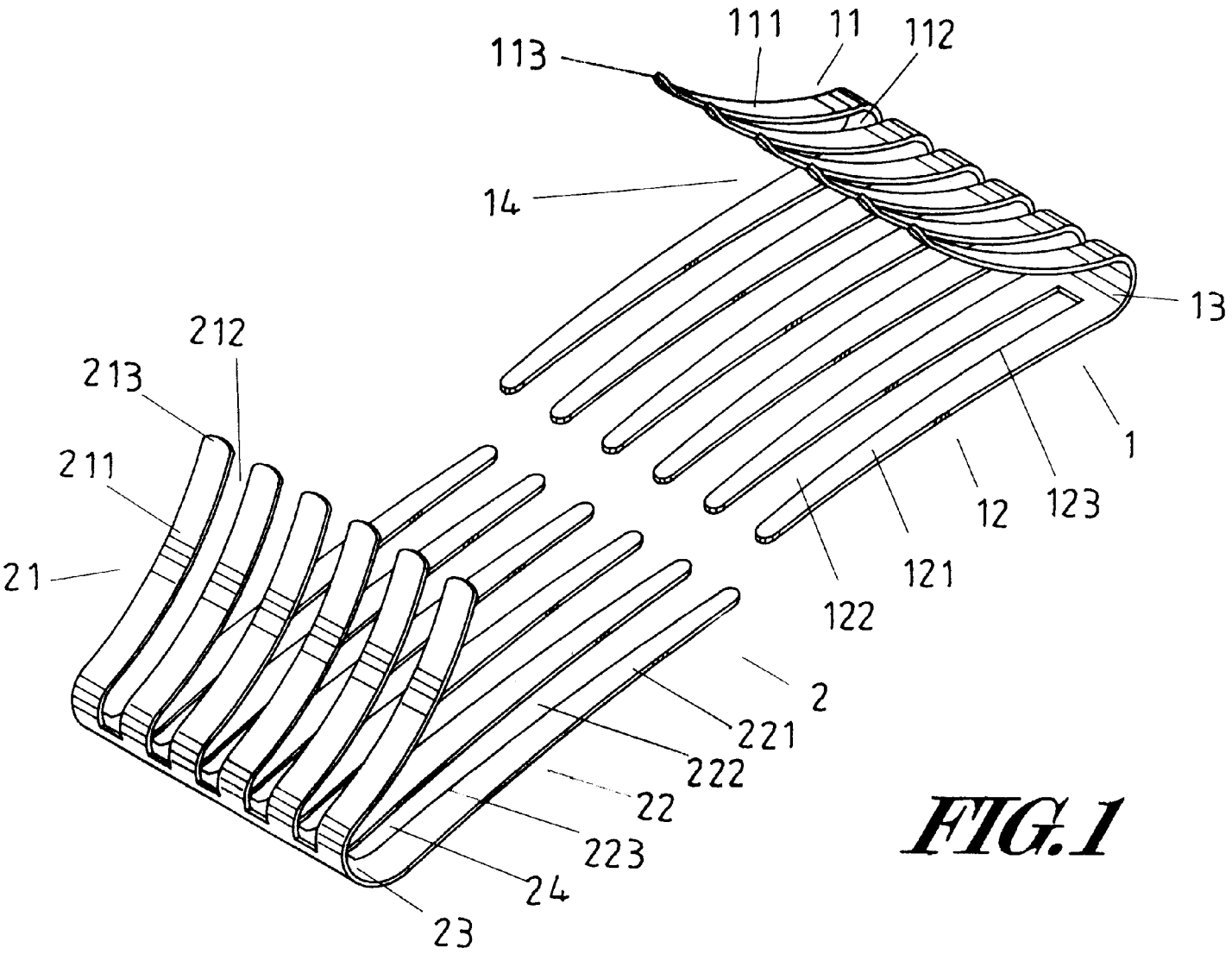
FIG. 1 is an exploded perspective view of a hair holder in accordance with the present invention.
Figure 2:
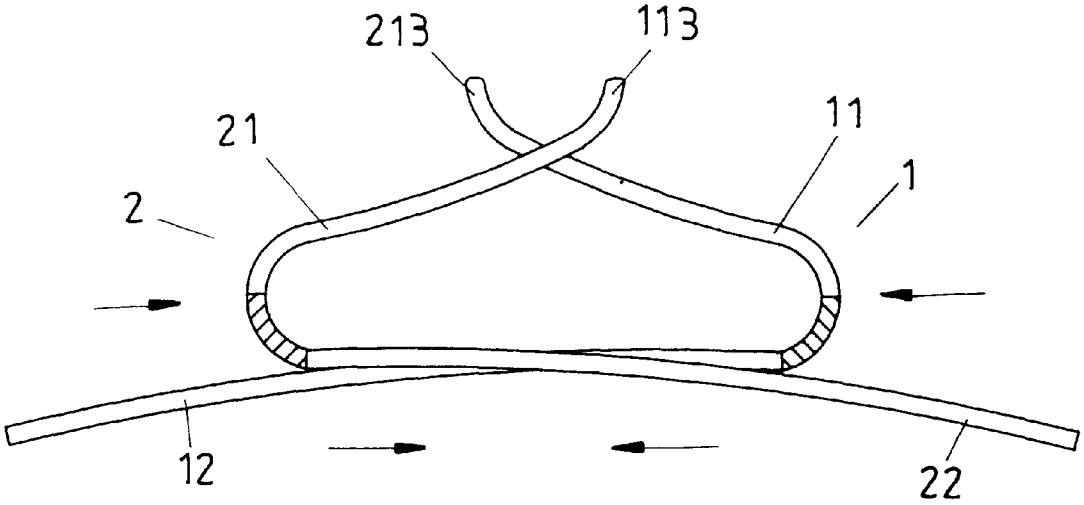
FIG. 2 is a schematic sectional view of the hair holder in use.
Figure 3:
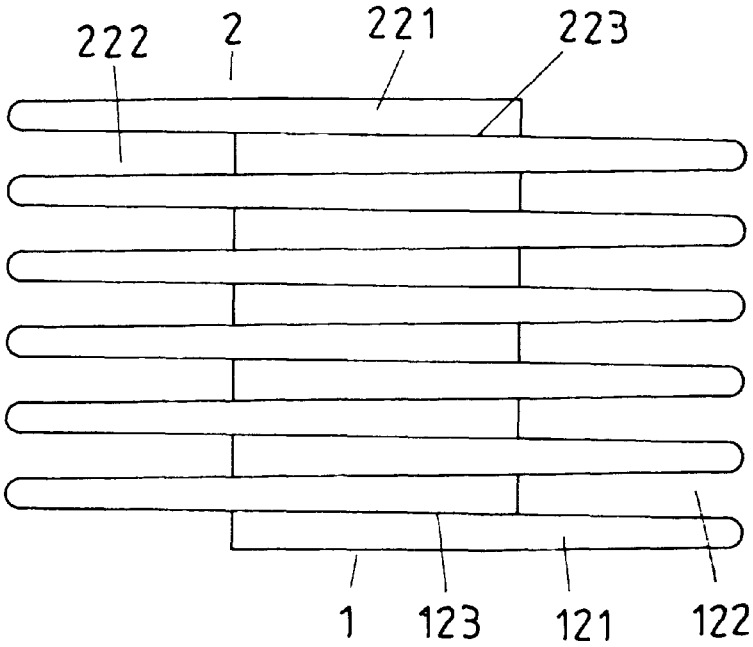
FIG. 3 is a bottom view of the hair holder in use.

Referring to the drawings and initially to FIGS. 1 through 3, a hair holder in accordance with the present invention generally includes two symmetric holder members 1 and 2 both integrally made of flexible material. Each holder member 1, 2 includes a first portion 11, 21 for holding hair, a second portion 12, 22 for retaining hair, and a transition portion 13, 23 interconnecting the first portion 11, 21 and the second portion 12, 22 in an acute angle to thereby define a hair holding space 14, 24. As can be seen from FIGS. 1 and 3, the first portion 11, 21 includes a plurality of first slits 112, 212 spaced along a width thereof to thereby define a plurality of teeth 111, 211 spaced along the width. The first portion 11, 21 further includes a distal end that extends upward and outward to form a grasp portion 113, 213. In addition, the second portion 12, 22 includes a plurality of second slits 122, 222 spaced along a width thereof to thereby define a plurality of teeth 121, 221 spaced along the width. The width of each tooth 121, 221 increases from a distal end to the transition portion 23, thereby defining an engaging portion 123, 223 adjacent to the transition portion 23.

In use, the teeth 121 and 221 of the holder members 1 and 2 are alternately disposed. More specifically, referring to FIGS. 2 and 3, the teeth 121 of the holder member 1 are inserted through the second slits 222 of the holder member 2 and the teeth 221 of the holder member 2 are inserted through the second slits 122 of the holder member 1. In addition, the teeth 111 of the holder member 1 are inserted through the first slits 212 of the holder member 2 and the teeth 211 of the holder member 2 are inserted through the first slits 112 of the holder member 1.

Figure 4:
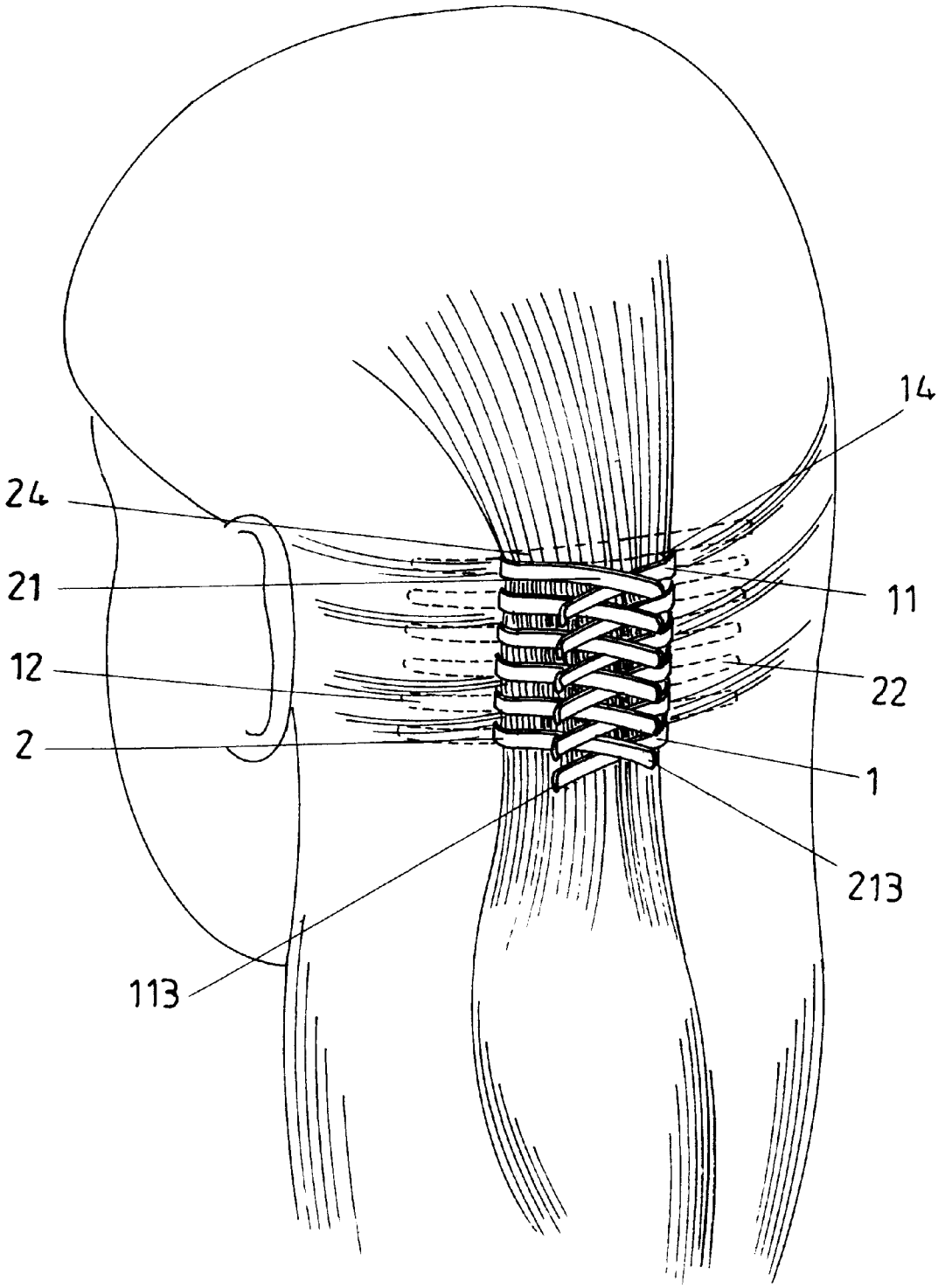
FIG. 4 is a schematic view illustrating use of the hair holder.
Figure 5:
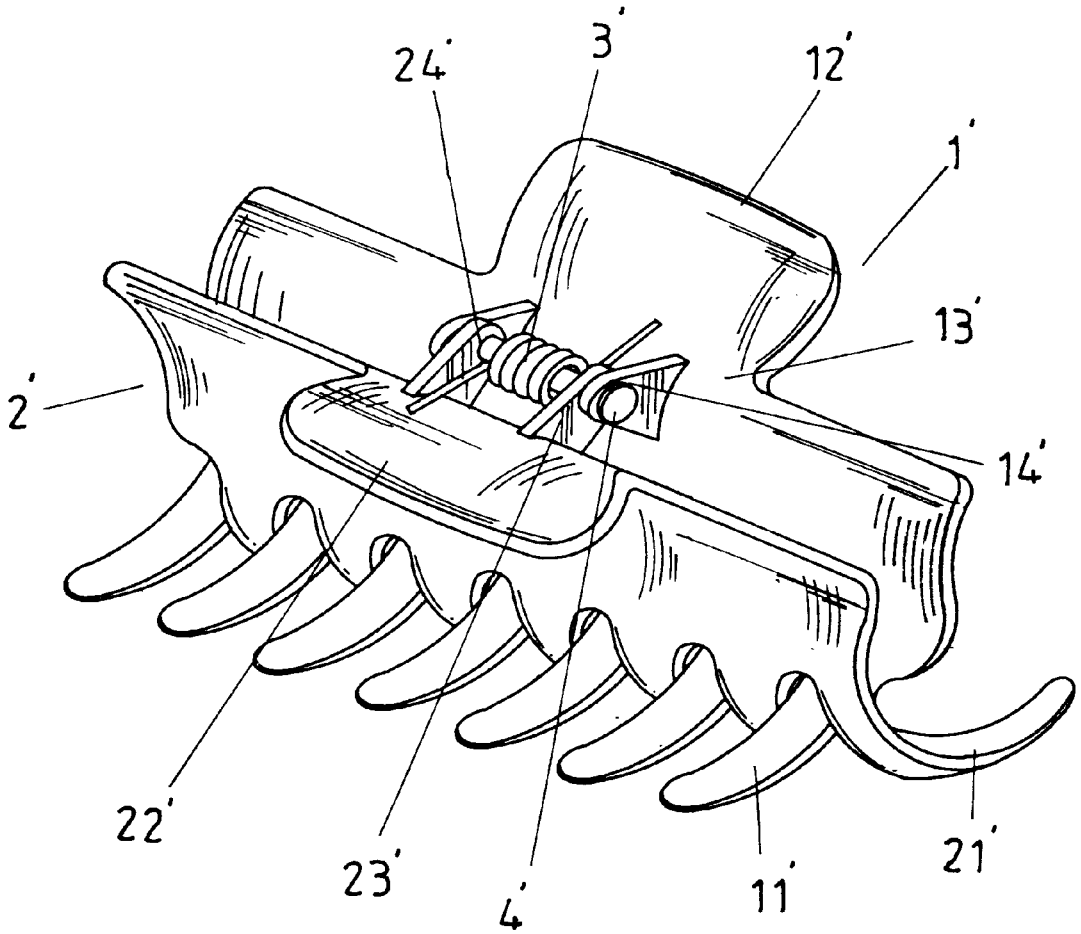
FIG.5 PRIOR ART
FIG. 5 is a perspective view of a conventional hair holder.
Figure 6:
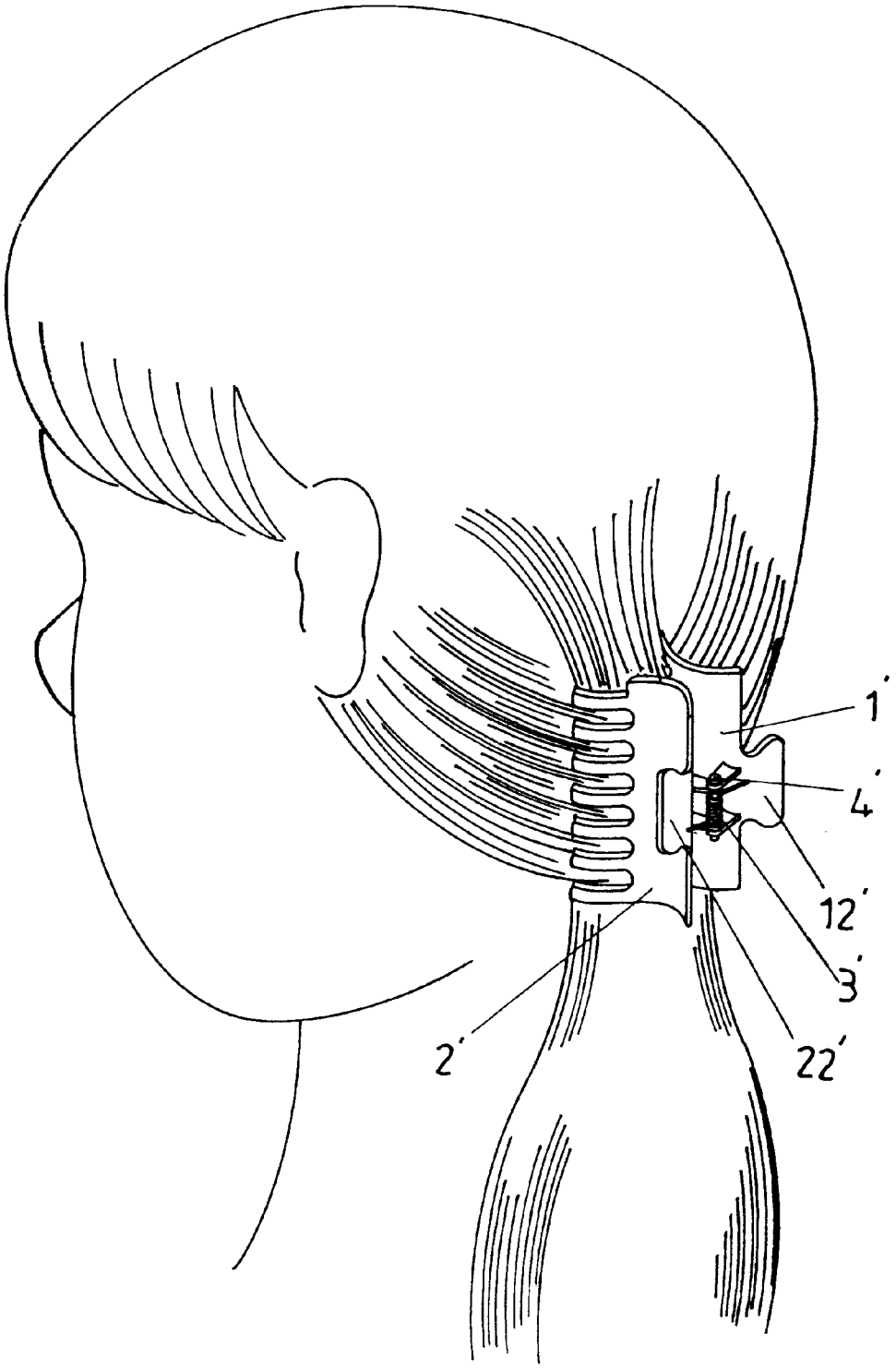
FIG.6 PRIOR ART
FIG. 6 is a schematic view illustrating use of the conventional hair holder.

Still referring to FIGS. 2 and 3 and further to FIG. 4, when in use, the user moves the holder members 1 and 2 (from both sides of the hair) toward each other to a position shown in FIG. 4. It is appreciated that the engaging portion 123 of each tooth 121 engages with the engaging portion 223 of the associated tooth 221 since the corresponding slits 122 and 222 have reduced width in this portion. This assures reliable engagement between the first and second holder members 1 and 2. The hair is held between a V-shaped compartment (FIG. 2) defined by the holder members 1 and 2. The V-shaped compartment is an enclosed compartment consisting of the hair holding space 14 of the holder member 1 and the hair holding space 24 of the holder member 2. The acute angle arrangement of the holder members 1 and 2 allows easy holding of the hair.

When removal of the holder members 1 and 2 is required, the user may grasp at the grasp portions 113 and 213 and make the holder members 1 and 2 move away from each other.

According to the above description, it is appreciated that the hair holder in accordance with the present invention has several advantages. Firstly, most portions of the holder members are hidden and thus less likely to be displaced or even disengaged from the hair as a result of being impinged by an alien object. This allows the user to move her head more freely. In addition, the holder members can be manufactured at high efficiency. Time-consunming and costly assembly procedure of the conventional hair holder with a pin and a spring is not required. Configuration of the holder members allows easy use and easy removal, and the holding effect is reliable.

Although the invention has been explained in relation to its preferred embodiment, it is to be understood that many other possible modifications and variations can be made without departing from the spirit and scope of the invention as hereinafter claimed.

What is claimed is:

1. A hair holder comprising:

two symmetric holder members made of flexible material, each said holder member including a first portion for holding hair, a second portion for retaining hair, and a transition portion interconnecting the first portion and the second portion in an acute angle to thereby define a hair holding space therebetween;

the first portion of each said holder member including a plurality of first slits spaced along a width thereof to thereby define a plurality of first teeth spaced along the width;

the second portion of each said holder member including a plurality of second slits spaced along a width thereof to thereby define a plurality of second teeth spaced along the width, the width of each said second tooth increasing from a distal end of the second portion to the transition portion, thereby defining an engaging portion adjacent to the transition portion;

whereby when in use, the second teeth of one of the holder members are inserted through the second slits of the other of the holder members until the engaging portions of the second portions of the holder members engage with each other, and the first teeth of one of the holder members are inserted through the first slits of the other of the holder members.

2. The hair holder as claimed in claim 1, wherein the first portion of each said holder member further includes a distal end that forms a grasp portion to allow disengagement of the holder members when the grasp portion of each said holder member is grasped.

* * * * *